US006393344B2

(12) United States Patent
Eastman et al.

(10) Patent No.: US 6,393,344 B2
(45) Date of Patent: May 21, 2002

(54) INTERFERENCE CURRENT MONITORING

(75) Inventors: Douglas Eastman, Ticknall; Glyn Orchard, Chellaston; Chris Bates, Ambergate, all of (GB)

(73) Assignee: DaimlerChrysler Rail Systems GmbH, Berlin (DE)

( * ) Notice: Subject to any disclaimer, the term of this patent is extended or adjusted under 35 U.S.C. 154(b) by 0 days.

(21) Appl. No.: 09/730,839

(22) Filed: Dec. 7, 2000

(30) Foreign Application Priority Data

Dec. 16, 1999 (GB) ..... 9929791

(51) Int. Cl.[7] ..... B61L 1/20; H02H 7/08
(52) U.S. Cl. ..... 701/19; 701/35; 246/193
(58) Field of Search ..... 701/19, 35; 246/193

(56) References Cited

U.S. PATENT DOCUMENTS 5,501,416 A * 3/1996 Capan ..... 246/194
5,666,382 A * 9/1997 Thakore ..... 348/384.1
5,711,497 A * 1/1998 Andrianos et al. ..... 246/167 R

FOREIGN PATENT DOCUMENTS

GB 2232836 A * 12/1990

* cited by examiner

*Primary Examiner*—Michael J. Zanelli
(74) *Attorney, Agent, or Firm*—Burns, Doane, Swecker & Mathis, L.L.P.

(57) ABSTRACT

Interference currents in railway trackside signaling apparatus are monitored by first and second transducers adapted to measure the traction current and frequency, respectively, of power electronics in traction systems of railway vehicles. An instantaneous interference current value is determined, based on data output from the first transducer. Data output from the second transducer is used to determine digital filter outputs for the trackside signaling frequencies for the interference current value. The determined interference current value and digital filter output values are recorded on a data storage medium and displayed on a display unit.

9 Claims, 2 Drawing Sheets

FIG. IA

INTERFERENCE CURRENT MONITORING

BACKGROUND OF THE INVENTION

Application No. 992 9791.3, filed in the United Kingdom on Dec. 16, 1999, and from which the present application claims priority under 35 U.S.C. § 119, is hereby incorporated by reference.

1. Field of the Invention

The invention relates to a method of monitoring interference currents, particularly, but not exclusively, in railway trackside signaling systems.

2. Description of Related Art

The introduction of power electronics in the traction systems of railway vehicles which is generally desirable has increased the possibility of interference with trackside signaling, communications and power supply systems. It is possible for harmonics to be generated in the earth return current from the traction system that are of sufficient magnitude and duration at specific frequencies to cause the track circuit relay to respond. Under certain conditions this can lead to a momentary signal change from red to green. This clearly has great safety implications.

Industry standard GS/ES1914 provides details relating to the permissible interference levels in trackside signaling equipment. By way of example, the standard provides that the interference levels should be set at less than 48 mA for Reed track circuits. This provides a target of about 5.3 mA for the measurement of interference currents in the presence of traction currents, which may be on the order of several kA.

It is known to measure the interference currents induced in trackside signaling using a combination of transducers to record the traction current and frequency. The transducers are typically installed on a test train which must be run up and down the track which is under study. The data recorded is then extracted and analyzed.

This procedure is time consuming, taking typically one or two days, and can result in too much analysis being undertaken and can also seriously extend the re-testing requirements. All of this is clearly undesirable. Accordingly, a method for carrying out the interference current monitoring and analysis more rapidly is needed.

SUMMARY OF THE INVENTION

In accordance with exemplary embodiments of the invention, interference currents in railway trackside signaling apparatus are monitored by first and second transducers adapted to measure the traction current and frequency, respectively. An instantaneous interference current value is determined, based on data output from the first transducer. Data output from the second transducer is used to determine digital filter outputs for the trackside signaling frequencies for the interference current value. The determined interference current value and digital filter output values are recorded on a data storage medium and displayed on a display unit.

The invention provides advantages over prior art methods in that it permits the data to be displayed on a real time basis. This in turn leads to much faster analysis of where, and under what conditions, false signals can be induced in signaling equipment.

In an exemplary embodiment of the invention, for a predetermined frequency corresponding to a frequency used in a trackside signaling system, the instantaneous interference current value is compared with a predetermined value.

If the current value exceeds a first predetermined limit, a warning signal is displayed on the display unit. If the current value exceeds a second predetermined limit, a danger signal is displayed on the display unit.

In accordance with an exemplary embodiment of the invention, the warning and danger signals are displayed as bar graphs. A point signal is also displayed. In the event of a warning and danger signal being displayed on the bar graph, the point signal can be switched to reflect the warning or danger signal.

In accordance with an exemplary embodiment of the invention, the instantaneous interference current value is compared with a predetermined value for each frequency used in a trackside signaling system.

In accordance with an exemplary embodiment of the invention, a data recording device is adapted to record data relating to vehicle speed and vehicle transmission settings.

In accordance with an exemplary embodiment of the invention, a data recording system is provided for recording data output from the first and second sensors, and includes a clock adapted to record the instantaneous time at which each current value is recorded.

BRIEF DESCRIPTION OF THE DRAWINGS

Other objects and advantages of the invention will become apparent to those skilled in the art from the following detailed description of preferred embodiments, when read in conjunction with the accompanying drawings. Like elements in the drawings have been designated by like reference numerals.

DETAILED DESCRIPTION OF THE INVENTION

Figure 1:
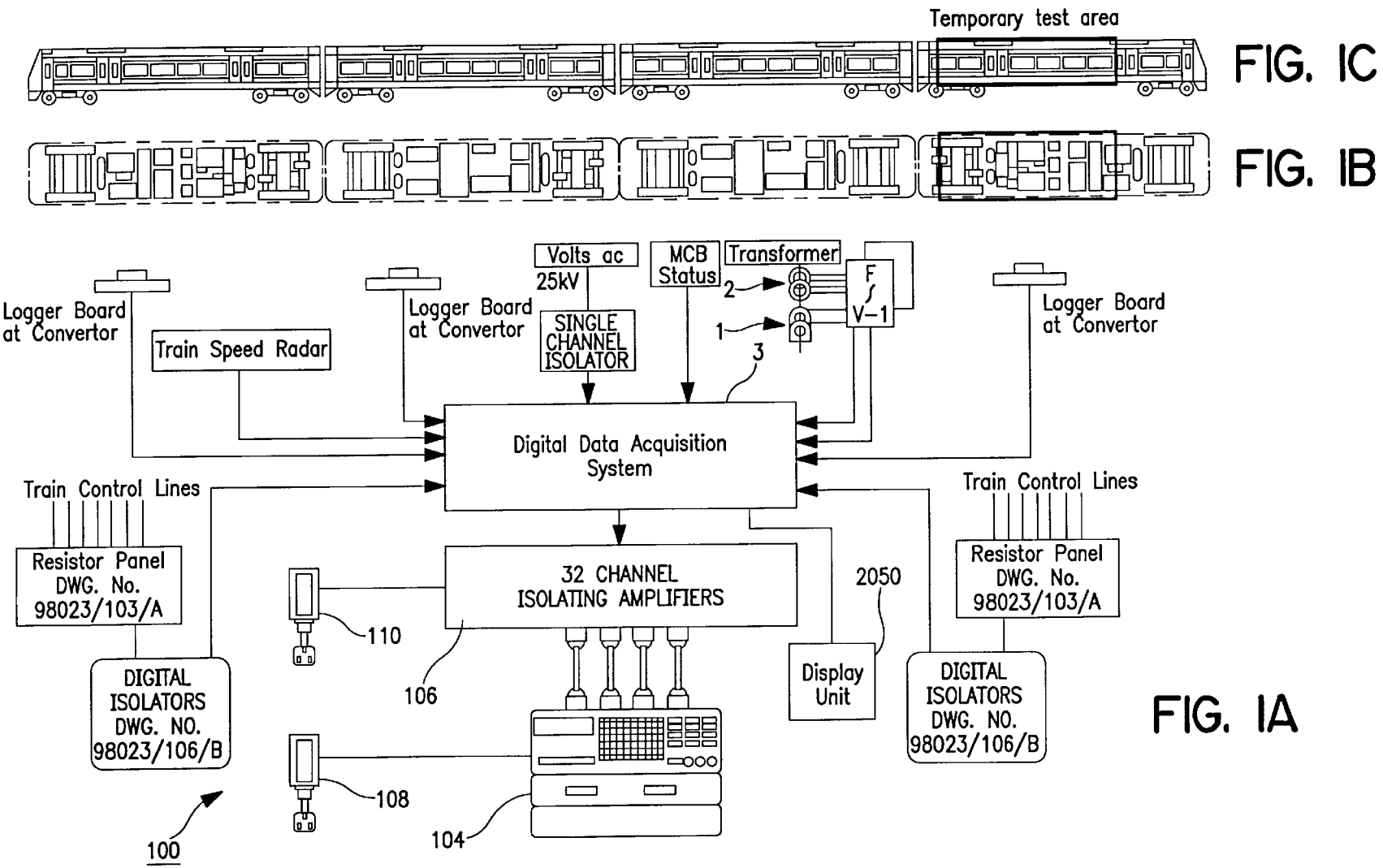
FIG. 1A shows a system block diagram of an exemplary embodiment of the invention.
FIG. 1B shows a top view of a train that is monitored by exemplary embodiments of the invention.
FIG. 1C shows a side view of the train of FIG. 1B.

In accordance with an exemplary embodiment of the present invention as shown in FIG. 1A, a current monitoring system 100 includes a combination of transducers, namely Hall Effect transducers 1, and Rogowski coils 2. The Hall Effect transducers can be, for example, those manufactured by LEM U.S.A., Inc. of Milwaukee, Wis. The Hall Effect transducers 1 are adapted to measure the main traction current of the train. This current can be quite large. For example, when the train is operating using 25 kV ac, a typical current is 100 Amperes at 50 Hertz. If the train is operating using 750 V dc, then a typical current is 2500 Amperes dc. Generally, Hall Effect transducers are only good at measuring large currents.

Rogowski coils 2 are provided for measuring small harmonic currents superimposed on the main traction current. Rogowski coils are excellent for measuring small currents, for example 1 mA at 408 Hertz, which is a typical signaling track circuit operating frequency within the United Kingdom. The Rogowski coils 2 are fitted with built in filters to remove any unwanted frequency components that may be generated. Thus, the Rogowski coils 2 are adapted to measure the smaller harmonic currents at certain specific frequencies. These specific frequencies are related to the normal operating frequencies of signaling, telecommunications and power supply equipment installed on the railway.

The outputs of the two types of transducers (Hall Effect and Rogowski) are fed to a Digital Data Acquisition System 3. The Digital Data Acquisition System 3 includes a computer card (not shown) having multiple input channels, a wide frequency range and a wide dynamic range.

The data is analyzed and displayed by sampling the output of the digital data acquisition system 3 at a rate of 8000 samples per second. Anti-aliasing filters are used where necessary if the sampling rate is insufficient. The data is then buffered and analyzed in 100 millisecond blocks. The data is separated into individual channels corresponding to the various inputs from the Hall Effect and Rogowski transducers, train speed, and so forth. Data from the Hall Effect channel is used to determine the DC content of the interference current. Data from the Rogowski channel is used to calculate digital filter outputs for the Reed and T121 frequencies as well as the power spectral display.

In use, for each frequency of interest, the instantaneous interference current value is determined and the data are recorded and displayed on a display unit. The display shows graphs of the interference current against frequency, so that the operator can observe the spectral data. For each relevant frequency in the trackside signaling systems, a bar graph showing the current at that frequency is displayed. The value of the interference current is compared against a first predetermined value or limit permitted by a regulatory standard. If the current value is within acceptable limits, the bar is colored green. If the current value approaches the first predetermined value, for example exceeds a second predetermined value that is less than, or more acceptable than, the first predetermined value, then the bar will become amber. If the current value exceeds the first predetermined value, then the bar will become red.

Adjacent to the bar graph is a spot signal. This signal is switched to amber or red if the current value approaches or exceeds the predetermined value in an analogous manner to the bar graph. After the current value returns to normal or dips below the limit indicated by the spot signal, the spot signal will remain at the amber or red settings, the spot signal will continue to display the color of the highest limit or predetermined value exceeded, until the operator resets the spot signal. This provides a clearer warning signal to the operator that a problem may be present at the particular frequency unit.

The "Logger Board at Convertor" elements shown in FIG. 1A translate the control and operational status of the main traction control motor convertors, into digital signals. The digital signals are transmitted to the Digital Data Acquisition System 3, where they are recorded. The digital signals can also be displayed on the visual display unit shown in FIG. 2. For example, a value of torque being generated by the traction motors, can be displayed on the visual display unit.

The "MCB Status" shown in FIG. 1A and input to the Digital Data Acquisition System 3, indicates whether a 25 kV circuit breaker on the roof of the train in FIGS. 1B, 1C is Open or Closed. When the circuit breaker is closed, it connects 25 kV collected by a pantograph mounted on the roof of the train, to a primary winding of a main 25 kV traction transformer of the train.

The "Train Control Lines" shown in FIG. 1C are electric control wires, that run the whole length of the train. In the driving compartment or cab at the front of the train, the Train Control Lines are connected to the train driver's controls, and transmit to each set of traction equipment on the train, instructions such as Forward, Neutral, Reverse, Power Notch 1 or 2 or 3, Braking Stop 1 or 2 or 3 or Emergency, and so forth.

The data collected by the Digital Data Acquisition System 3 can, for example, be recorded on a Digital Data Acquisition Tape Recorder 104 that is part of, or connected to, the Digital Data Acquisition System 3. The Recorder 104 can, for example, be a Sony 16-channel recorder that is fitted with a 16-channel expander unit and thereby capable of recording 32 channels of data. In accordance with principles known in the electronic data acquisition arts, a 32 channel isolating amplifier unit 106 can be connected between the Digital Data Acquisition System 3 and the recorder 104. The unit 106 and the recorder 104 are respectively supplied with electrical power by power supply units 110, 108. The power supply units 110, 108 can, for example, be plugged into a main power supply of the train.

The Digital Data Acquisition System 3 can also include, or be connected to, a display unit 2050 that displays data acquired by the System 3.

Figure 2:
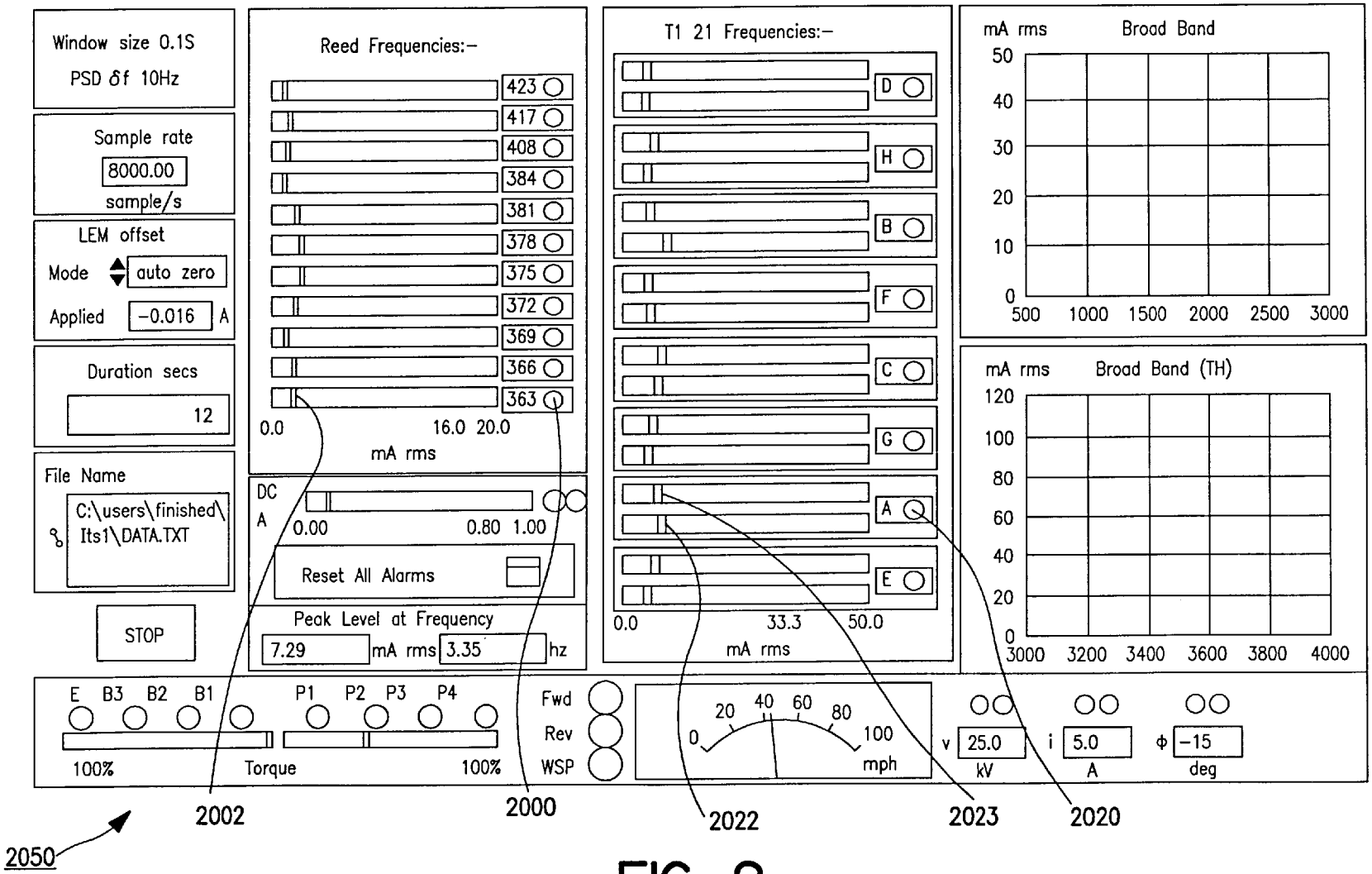
FIG. 2 shows a display screen in accordance with an exemplary embodiment of the invention.

FIG. 2 illustrates an exemplary details of the display unit 2050. In particular, as shown in FIG. 2, the display unit 2050 can have bar graphs and spot signals. For example, in FIG. 2 the reference number 2000 indicates a spot signal for a specific Reed frequency and the reference number 2002 indicates a corresponding bar graph reading of current for the Reed frequency. The reference number 2020 indicates a spot signal for a T121 frequency A, and the reference numbers 2022, 2023 indicate bar graph readings of currents corresponding to the T121 frequency A. Similar bar graphs and spot signals are also shown for other Reed and T121 frequencies.

Data relating to the train speed and transmission settings is also recorded by the data recording system and displayed on the display unit. For example, as shown in the bottom portion of FIG. 2, values for dynamic braking and drive torque can be displayed via both bar graphs and spot signals, speed is displayed for example with a needle and scale, and digital values of voltage and current being provided to a train drive motor/traction system, as well as a phase of the voltage with respect to the current, are also displayed. Although the majority of interference current problems can be attributed directly and simply to the traction current or current flowing through the traction system or motor drive of the train, under certain circumstances, a problematic interference current will only be generated at a certain train speed or transmission setting or under certain braking conditions. It is therefore advantageous to record data concerning train speed and transmission settings also, so that the problem can be localized and corrective measures can be taken on the train.

As shown in the right side of FIG. 2, the display unit can include one or more graphic displays to show graphs of frequency vs. current, and thereby provide a comprehensive overview depending on the range of the graphic displays.

After data capture has been completed, it is also possible to construct a plot of current values against frequency with respect to time. Such plots are a highly advantageous aid in viewing the interference current problems on a particular line.

In an alternative embodiment the data recording system can include a digital tape system having a tape recorder with multiple input channels, a wide frequency range, and a wide dynamic range.

It will be appreciated by those skilled in the art that the present invention can be embodied in other specific forms without departing from the spirit or essential characteristics thereof, and that the invention is not limited to the specific embodiments described herein. The presently disclosed embodiments are therefore considered in all respects to be illustrative and not restrictive. The scope of the invention is indicated by the appended claims rather than the foregoing description, and all changes that come within the meaning and range and equivalents thereof are intended to be embraced therein.

What is claimed is:

1. A method for monitoring interference currents generated by an electronic vehicle traction system, that affect a railway trackside signaling apparatus, comprising:

providing at least one transducer of a first type and at least one transducer of a second type, wherein the at least one transducer of the first type is adapted to measure a traction current of a locomotive, and the at least one transducer of the second type is adapted to measure a frequency of the traction current;

sampling data output from the at least one transducer of the first type and data output from the at least one transducer of the second type;

determining an instantaneous interference current value based on the sampled data output from the at least one transducer of the first type;

determining digital filter outputs for trackside signaling frequencies for the determined instantaneous interference current value, based on the sampled data output from the at least one transducer of the second type; and performing at least one of a) recording the determined instantaneous interference current value and the determined digital filter outputs on a data storage medium, and b) displaying the determined instantaneous interference current value and the determined digital filter outputs on a display unit.

2. A method according to claim 1, further comprising:

comparing the determined instantaneous interference current value with a first predetermined value, for a predetermined frequency corresponding to a frequency used in a trackside signaling system; and displaying a warning signal on the display unit, when the determined instantaneous interference current value exceeds the first predetermined value.

3. A method according to claim 2, further comprising:

displaying a danger signal on the display unit, when the predetermined current value exceeds a second predetermined value.

4. A method according to claim 3, wherein:

the step of displaying the warning signal comprises displaying the warning signal as a bar graph and switching a corresponding point signal to the warning signal; and the step of displaying the danger signal comprises displaying the danger signal as a bar graph and switching a corresponding point signal to the danger signal.

5. A method according to claim 1, further comprising comparing the determined instantaneous interference current value with a predetermined value for each frequency used in a trackside signaling system.

6. A method according to claim 1, further comprising recording data relating to vehicle speed and vehicle transmission settings.

7. A method according to claim 1, further comprising recording the instantaneous time at which each determined instantaneous interference current value is recorded.

8. A method according to claim 1, wherein the steps of displaying and recording are performed simultaneously.

9. A method according to claim 1, wherein the steps of claim 1 are performed in realtime.

* * * * *